US009803298B2

(12) United States Patent
Beda et al.

(10) Patent No.: US 9,803,298 B2
(45) Date of Patent: Oct. 31, 2017

(54) COOLING SHIRT AND METHOD OF MAKING SAME

(71) Applicant: Atomi, Inc., New York, NY (US)

(72) Inventors: Steven K. Beda, Brooklyn, NY (US); Xunhui Chen, Jiaxing (CN); William J. Beda, Brooklyn, NY (US)

(73) Assignee: ARCTIC COOL, LLC, New York, NY (US)

( * ) Notice: Subject to any disclaimer, the term of this patent is extended or adjusted under 35 U.S.C. 154(b) by 484 days.

(21) Appl. No.: 14/592,442

(22) Filed: Jan. 8, 2015

(65) Prior Publication Data

US 2016/0177482 A1 Jun. 23, 2016

Related U.S. Application Data

(60) Provisional application No. 62/094,170, filed on Dec. 19, 2014.

(51) Int. Cl.

| | |
|---|---|
| ***D04B 1/18*** | (2006.01) |
| ***D04B 1/16*** | (2006.01) |
| ***A41D 1/04*** | (2006.01) |
| ***D04B 1/24*** | (2006.01) |

(52) U.S. Cl.

CPC ..... *D04B 1/16* (2013.01); *A41D 1/04* (2013.01); *D04B 1/246* (2013.01); *A41D 2400/20* (2013.01); *A41D 2400/22* (2013.01); *A41D 2400/60* (2013.01); *A41D 2500/10* (2013.01)

(58) Field of Classification Search

CPC ..... D04B 1/18
USPC ..... 442/306, 310
See application file for complete search history.

(56) References Cited

U.S. PATENT DOCUMENTS

| | | | | |
|---|---|---|---|---|
| 3,453,662 | A | 7/1969 | Weiss | |
| 4,371,485 | A | 2/1983 | Mathes et al. | |
| 5,462,790 | A | 10/1995 | Matsuki et al. | |
| 8,440,119 | B2 * | 5/2013 | Ackroyd | D03D 15/00 264/103 |
| 2005/0183463 | A1 | 8/2005 | Laycock et al. | |

(Continued)

OTHER PUBLICATIONS

CoolPass, Jiangsu Hengli Chemical Fibre Co., Ltd, Product Introduction; Jul. 2, 2007.

(Continued)

*Primary Examiner* — Jenna Johnson
(74) *Attorney, Agent, or Firm* — Gordon & Jacobson, P.C.

(57) ABSTRACT

A cooling shirt is disclosed. The shirt is formed from a resilient fabric comprised of a first yarn of a first material and a second yarn of a second material twisted and knitted together. In one embodiment, the first yarn is formed from fibers have surfaces adapted to channel liquid from wet areas to dry areas and the yarn has pores adapted to permit evaporation of liquid vapor therethrough, and the second yarn is resilient and capable of being stretched at least 300% without deforming. The first yarn constitutes between 85% and 95% of the weight of the fabric with the second yarn constituting the remainder. In one embodiment the resilient fabric is capable of being resiliently stretched at least 40% in each of two perpendicular directions without tearing and returning immediately to its at-rest position. In one embodiment, the first yarn has a porosity of between approximately 20% and 45%.

20 Claims, 3 Drawing Sheets

(56) References Cited

U.S. PATENT DOCUMENTS

| | | | | |
|---|---|---|---|---|
| 2006/0099866 | A1* | 5/2006 | Leonard | A01N 25/34<br>442/181 |
| 2007/0000066 | A1* | 1/2007 | Chuang | D06P 1/18<br>8/115.51 |
| 2007/0004303 | A1 | 1/2007 | Tanaka et al. | |
| 2008/0070460 | A1 | 3/2008 | Liao | |
| 2008/0318485 | A1 | 12/2008 | Cheng | |

OTHER PUBLICATIONS

Process Equipment, Jiangsu Hengli Chemical Fibre Co., Ltd, downloaded Sep. 10, 2014.

* cited by examiner

COOLING SHIRT AND METHOD OF MAKING SAME

BACKGROUND

1. Field

This disclosure relates to apparel. More particularly, this disclosure relates to a shirt exhibiting "cooling" characteristics and methods of making the same.

2. State of the Art

Outdoor activity in the heat and physical exertion from work or sports causes the human body to heat up, resulting in sweat which removes heat from the body. Over the years, people have used various techniques to keep themselves cool in the outdoors and during physical exertion. One example of a cooling technique is the pouring of cold water on the skin and/or clothes of the person attempting to keep cool. Another example is the consumption of cold liquids which tends to result in profuse sweating, thereby reducing the body temperature. More recently, lines of clothing have been introduced that are made from fabric that wicks sweat away from the skin and keeps the wearer dry. These fabrics typically utilize a hydrophilic material which pulls the moisture (sweat) from the skin, and permits it to evaporate into the surrounding atmosphere.

By the middle of 2007, a polyester fiber with a substantially "X" shaped cross-section as shown in FIG. 1*a* was introduced for the purpose of speeding up moisture absorption and diffusion. The fiber, called "CoolPass", and available from Jiangsu Hengli Chemical Fibre Co., Ltd. of Jiangsu, China, is formed by injection nozzle and has four concave sides and four rounded convex corners with channels being formed along the four concave sides of the surface of the fiber. These channels permit the ready channeling (distribution) of liquid from wet areas to dry areas.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A shirt is made from a fabric formed from yarns of two different fibers that are twisted together and knitted or woven. A first of the yarns which constitutes between 85% and 95% by weight of the fabric is a porous yarn formed from polyester fibers having four concave sides and four rounded convex corners (such as CoolPass). A second of the yarns which constitutes the remainder by weight of the fabric is formed from fibers made of a highly elastic polyurethane-polyurea copolymer (e.g., spandex). During the twisting and knitting process, the first yarn is kept at a relatively low tension and the second yarn is kept at a relatively high tension. In one embodiment, the second yarn is stretched to about 300% its at-rest length during the twisting and knitting process. In one embodiment, the fabric is resilient in that it can be stretched up to 40% in each of two directions without tearing and return immediately to its at-rest position. In another embodiment, the fabric can be stretched up to 60% in each of two directions without tearing and return immediately to its at-rest position.

In one embodiment, the porous polyester yarn is a 75 Denier to 100 Denier yarn formed from hydrophilic polyester fibers having four concave sides and four rounded convex corners and constituting approximately 90% by weight of the fabric, and the polyurethane-polyurea copolymer yarn constitutes approximately 10% by weight of the fabric and has a Denier of between 30 D and 40 D. For purposes herein, the term "approximately" when referring to weight percentages is to be understood to be ±3% such that approximately 90% by weight is to be understood as between 87% and 93% by weight, and approximately 10% by weight is to be understood as between 7% and 13% by weight.

In one embodiment, the knit of the fabric has between twenty-four and thirty-two stitches per inch with a plain, jacquard, or double knit, and the fabric weight is 180 g/m2. In one embodiment, the first and second yarns are twisted at least once per stitch.

According to one aspect, the shirt may be of any typical shirt form such as a sleeveless shirt, a t-shirt with short sleeves, a t-shirt with partial or long sleeves, a t-shirt with a crew neck, a t-shirt with a collar, a t-shirt with a v-neck, etc. The shirt generally includes a front panel and a rear panel usually stitched together at a seam, although buttons, one or more zippers, or other fasteners such as Velcro could be utilized. The seam location and format and/or the fasteners may constitute part of the design of the shirt. The neckline, sleeve ends and bottom of the shirt are typically folded over to form a double thickness fabric and stitched at seams.

According to one aspect, when the shirt is worn, sweat of the user will be quickly absorbed into the fabric of the shirt and will be slowly dissipated through the pores of the fabric to the environment. According to another aspect, prior to placing the shirt on the user's body, the shirt may be subjected to being wetted by water (hot or cold) so that the water is absorbed by the shirt fabric. The fabric may be wrung out and then snapped (quickly expanded and released) so that water moves into the pores of the porous hydrophilic polyester yarns of the fabric. When then shirt is donned, the fabric will feel cold to the touch and will remain cold to the touch for an hour or more even when used outdoors. Moreover, sweat of the user will be absorbed and wicked away from the user.

DETAILED DESCRIPTION

For purposes herein, when a range is provided, the range is intended to be inclusive of the numbers setting the range, regardless of whether the word "inclusive" is used therewith.

Figure 1A:
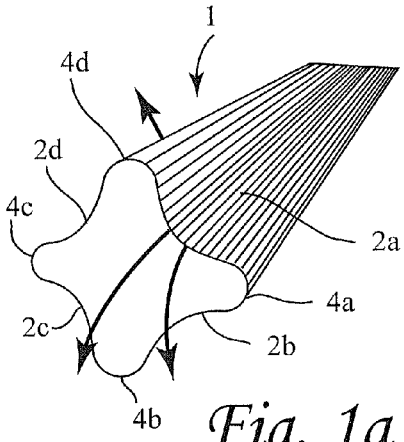
Fig. 1a Prior Art
FIG. 1*a* is a prior art schematic of a hydrophilic polyester fiber.

As previously mentioned, FIG. 1*a* shows a prior art polyester fiber 1 with a substantially "X" shaped cross-section. The fiber, called "CoolPass", available from Jiangsu Hengli Chemical Fibre Co., Ltd. of Jiangsu, China, is formed by injection nozzle. In one embodiment, the polyester material of fiber 1 is a hydrophilic fiber formed from materials such as described in U.S. Pat. No. 4,371,485 to Mathes et al. which is hereby incorporated by reference herein in its entirety. Regardless, the fiber is formed with four concave sides 2*a*-2*d* and four rounded convex corners 4*a*-4*d*. The convex sides form channels along the surface of the fiber. These channels permit the ready channeling (distribution) of liquid from wet areas to dry areas (as suggested by the two front-directed arrows).

Figure 1B:
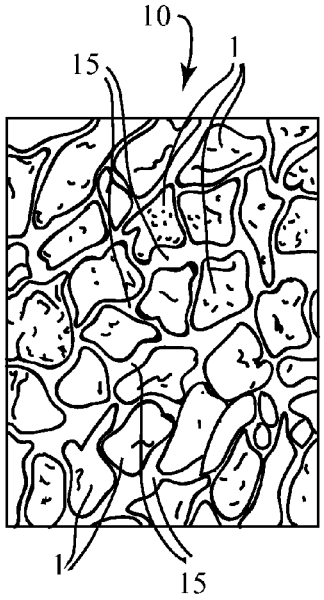
FIG. 1*b* is a highly magnified partial cross-section of a porous yarn formed from hydrophilic polyester fibers.

A partial cross-section of a yarn 10 formed from fibers such as polyester fibers 1 is seen in FIG. 1*b*. Yarn 10 is seen to include numerous fibers 1 with irregular channels 15 being formed between and amongst the fibers 1. The channels 15 provide a porosity to the yarns such that not only can moisture be channeled along the yarn, it can also travel through the yarn (in a direction perpendicular to the arrows of FIG. 1*a*). In one embodiment, the yarn 10 has a porosity of between approximately 20% and approximately 45% such that the pores, by area constitute between approximately 20% and approximately 45% of the cross-sectional area of the yarn. In another embodiment, the yarn has a porosity of approximately 32% and approximately 45%. In another embodiment, the yarn has a porosity of approximately 35% to approximately 40%. In one embodiment, the fibers have a diameter of between approximately 4 and 18 microns. In another embodiment, the fibers have a diameter of between approximately 10 and 16 microns. In one embodiment, a yarn includes between 20 and 100 fibers at any cross-sectional location. In another embodiment, a yarn includes between 50 and 85 fibers at any cross-sectional location.

Thus, the yarn of FIG. 1*b*, when formed into a fabric, exhibits excellent wicking ability as well as excellent diffusion ability, the combination of which results in excellent cooling characteristics.

Figure 2:
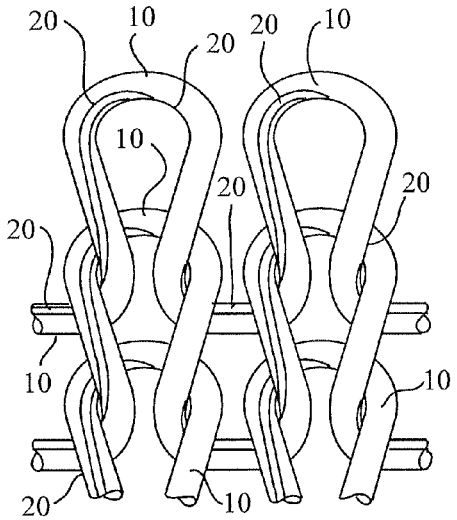
FIG. 2 is a schematic of a plain knit.

In one embodiment, a fabric is formed from a porous yarn 10 of first fibers such as the polyester fibers 1 with the four concave sides and four rounded convex corners, and from a second yarn 20 formed from fibers such as highly elastic polyurethane-polyurea copolymer (e.g., spandex) fibers, where the first and second yarns are twisted together and knitted as in the plain or weft knit of FIG. 2 or using another knit such as, by way of example and not by way of limitation a jacquard or a double knit, and where the first fibers of the first yarn 10 constitute between 85% and 95% of the weight of the fabric and the fibers of the second yarn 20 constitute the remainder. Thus, in one embodiment, the first fibers 1 constitute approximately 90% by weight of the fabric and the second fibers constitute approximately 10% by weight of the fabric. In FIG. 2, each loop or wale includes a twist of the first yarn 10 and second yarn 20, with the yarns 10 and 20 twisted by one twist per loop. In one embodiment, the yarns 10 and 20 are twisted by at least one half twist per loop. In one embodiment, the yarns 10 and 20 are twisted by two twists per loop. In one embodiment, the knit of the fabric has between twenty-four and thirty-two wales per inch.

Figure 3B:
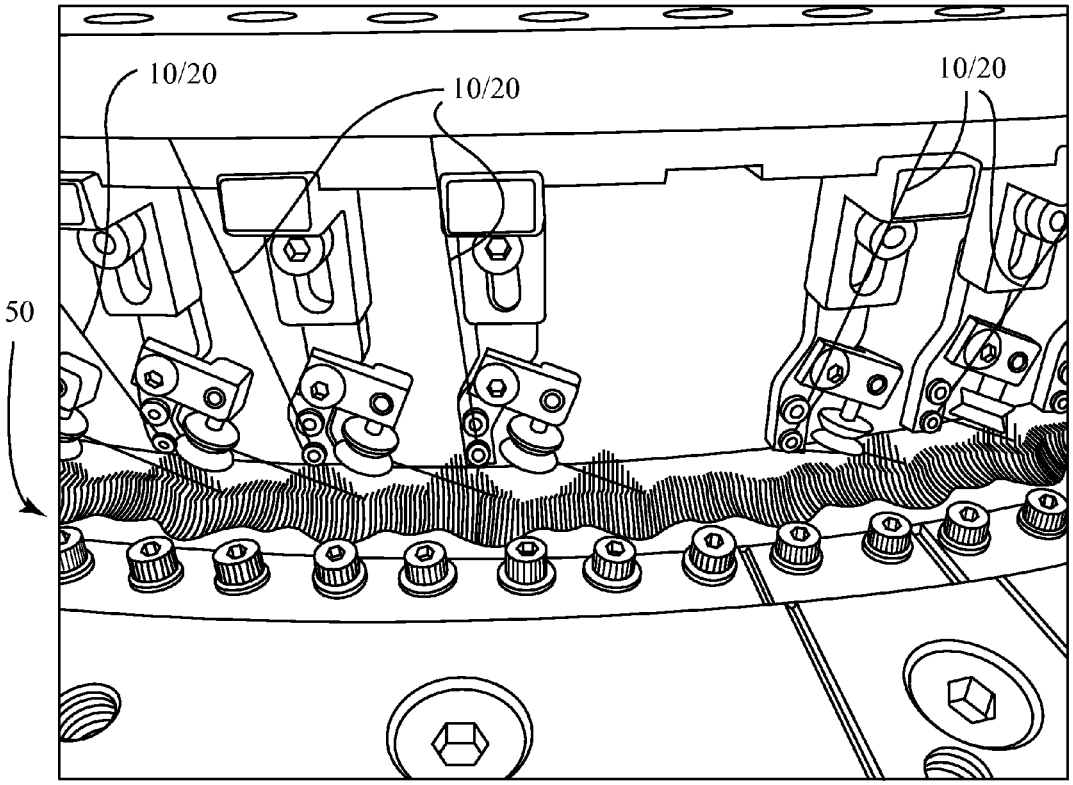
FIGS. 3*a* and 3*b* are respectively photographs of a knitting machine and a portion thereof.
Figure 3A:
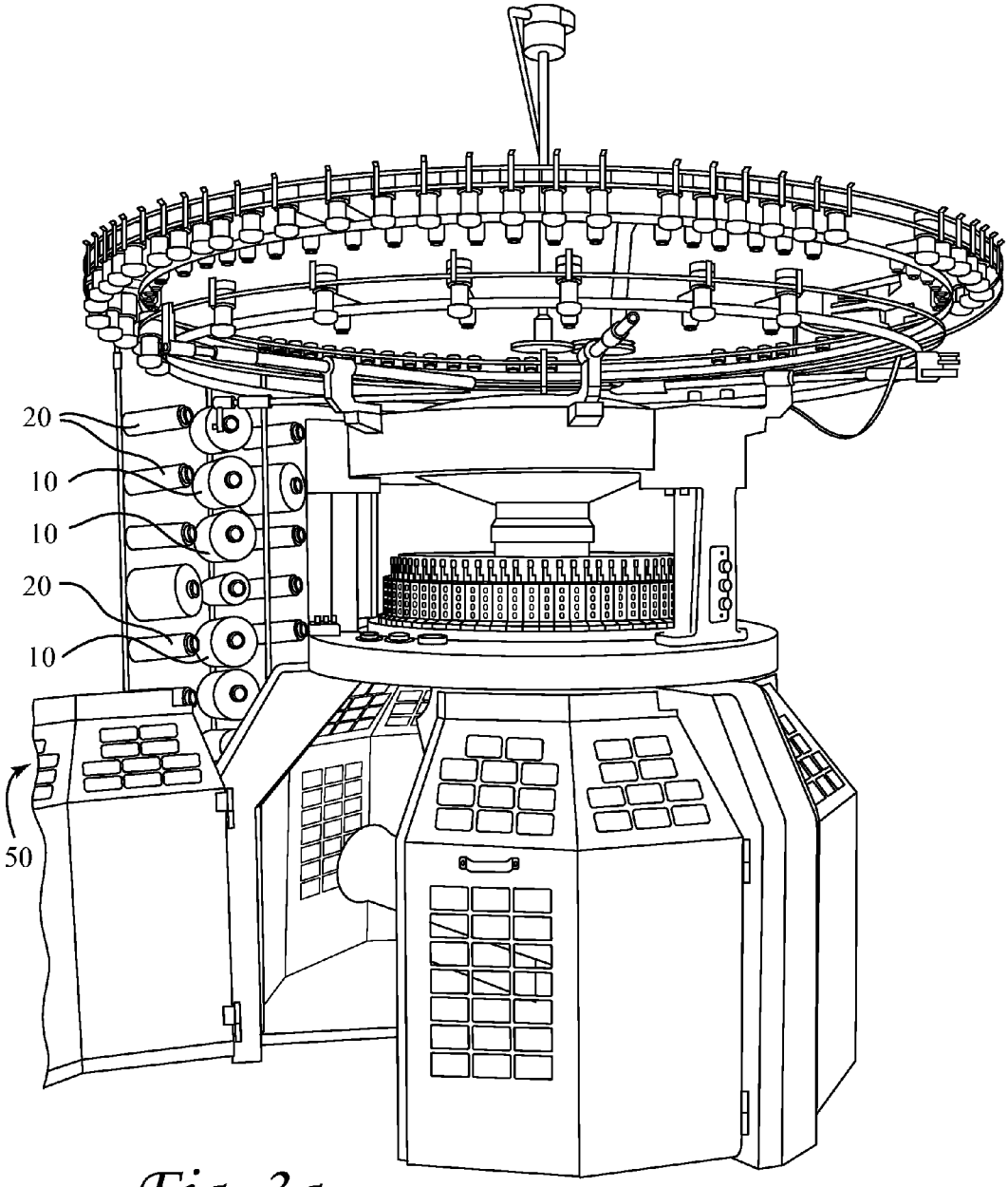

A knitting machine 50 for twisting yarns 10 and 20 together and knitting the twisted yarns is seen in FIGS. 3*a* and 3*b*. As seen in FIG. 3*a*, multiple strands of each of yarns 10 and 20 are fed to multiple locations of the machine 50 where they are twisted and the twisted yarns 10/20 (five shown in FIG. 3*b*) are subsequently knitted by the machine 50. The knitting machine shown in FIG. 3*a* is a circular knitting machine, manufactured by Unitex of Singapore, although, other circular and non-circular knitting machines may be utilized. During the twisting process, the first yarn is kept at a relatively low tension (i.e., unstretched), whereas the second yarn is kept at a relatively high tension. In one embodiment, the second yarn is stretched to between 200% and 500% of its at-rest length during the twisting and knitting process. In one embodiment, the second yarn is stretched to between 250% and 350% its at-rest length during the twisting and knitting process. In one embodiment, the fabric is resilient in that it can be stretched up to 40% without tearing and return immediately to its at-rest position. In another embodiment, the fabric can be stretched up to 50% without tearing and return immediately to its at-rest position. In another embodiment, the fabric can be stretched up to 60% without tearing and return immediately to its at-rest position.

In one embodiment the porous polyester yarn 10 is a hydrophilic porous polyester fiber that constitutes approximately 90% by weight of the fabric and is has a Denier of between 75 D and 100 D, the polyurethane-polyurea copolymer yarn 20 constitutes approximately 10% by weight of the fabric and has a Denier of between 30 D and 40 D, the knit of the fabric has between twenty-four and thirty-two stitches per inch with a plain weave, and the fabric weight is between 160 g/m2 and 200 g/m2 (e.g., 180 g/m2).

Figure 4:
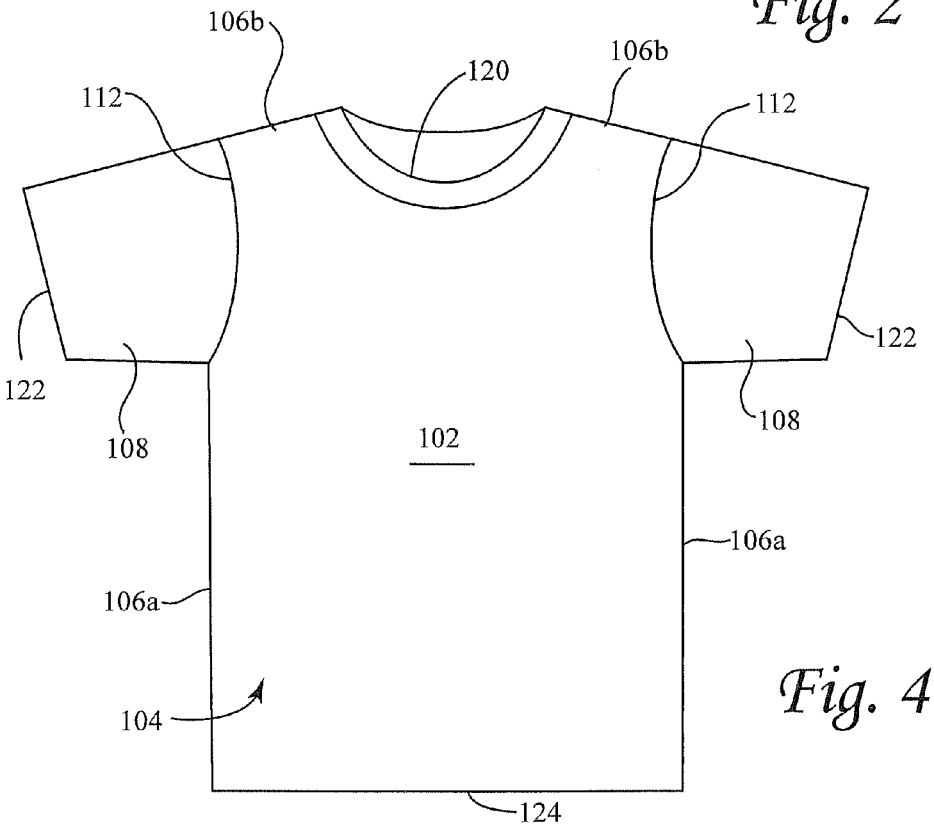
FIG. 4 is a schematic of a t-shirt.

According to one aspect, the knit fabric is made into a shirt. The shirt may be of any typical shirt form such as a sleeveless shirt, a t-shirt with short sleeves, a t-shirt with partial or long sleeves, a t-shirt with a crew neck, a t-shirt with a collar, a t-shirt with a v-neck, etc. One embodiment of a shirt is shown in FIG. 4, with the shirt 100 generally including a front panel or portion 102 and a rear panel or portion 104 stitched together at side seams 106*a* and shoulder seams 106*b*, although buttons, one or more zippers, or other fasteners such as Velcro could be utilized. Short sleeves 108 are attached to the front and rear panels 102, 104 by seams 112. The seam location and format and/or the fasteners may constitute part of the design of the shirt. The neckline 120, sleeve ends 122 and bottom 124 of the shirt are typically folded over to form a double thickness fabric and stitched at seams.

In one embodiment, a shirt has at least one panel, such as a front panel and/or a rear panel made from the fabric formed from porous polyester yarn 10, and from a second yarn 20 formed from fibers such as highly elastic polyurethane-polyurea copolymer (e.g., spandex) fibers, where the first and second yarns are twisted together and knitted and where the first yarn 10 constitutes between 85% and 95% of the weight of the fabric and the second yarn 20 constitute the remainder. In one embodiment, front and rear panels of a shirt are attached using side panels. The side panels may be formed from the same fabric used for the front and/or rear panels, or from a different fabric. The different fabric may utilize the same first and second fibers, but may be knitted or woven differently, e.g., to provide mesh or micromesh vents. Or, the different fabric may utilize different fibers.

According to one aspect, when the shirt is worn, sweat of the user will be quickly absorbed into the fabric of the shirt and will be slowly dissipated through the pores in the porous yarn 10 of the fabric to the environment. According to another aspect, prior to placing the shirt on the user's body, the shirt may be subjected to being wetted by water (hot or cold) so that the water is absorbed by the shirt fabric. The fabric may be wrung out and then snapped (quickly expanded and released) so that water moves into the pores of the porous hydrophilic polyester yarn of the fabric. When the shirt is donned, the fabric will feel cold to the touch and will remain cold to the touch for an hour or more even when used outdoors or indoors in a hot temperature environment. Moreover, sweat of the user will be absorbed and wicked away from the user and will keep the fabric cool to the touch.

There have been described and illustrated herein several embodiments of a shirt having cooling properties and methods of making and using the same. While particular embodiments have been described, it is not intended that the invention be limited thereto, as it is intended that the invention be as broad in scope as the art will allow and that the specification be read likewise. Thus, while a particular knit was described, it will be appreciated that other knits or weaves could be utilized. Also, while particular fibers such as CoolPass and spandex were described, it will be appreciated that other fibers having similar characteristics could be utilized in making a fabric that is formed into a shirt. Also, while the spandex fibers were described as being formed into a yarn of spandex, it will be appreciated that in some circumstances, it may be possible to form the spandex yarn from a single fiber. Thus, for purposes herein, the term "yarn" may be considered to be comprised of a single fiber or of multiple fibers. It will therefore be appreciated by those skilled in the art that yet other modifications could be made to the provided invention without deviating from its spirit and scope as claimed. In the claims, means-plus-function clauses, if any, are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A shirt, comprising:

a front panel and a rear panel connected together and defining a neck opening, at least one of said front panel and said rear panel formed from a resilient fabric formed from a first yarn twisted with a second yarn and knitted together while said second yarn is stretched at least 200% of its at-rest length, said first yarn being porous and formed from hydrophilic polyester fibers with four concave sides and four rounded convex corners and constituting between 85% and 95% of the weight of the fabric, and said second yarn being formed from a highly elastic polyurethane-polyurea copolymer and constituting the remainder of the fabric by weight.

2. A shirt according to claim 1, wherein:

said second yarn is stretched between 200% and 500% of its at-rest length when knitted together with said first yarn.

3. A shirt according to claim 2, wherein:

said resilient fabric is sufficiently resilient that it can be stretched at least 40% in each of two perpendicular directions without tearing and return immediately to its at-rest position.

4. A shirt according to claim 3, wherein:

said first yarn has a porosity of between approximately 20% and approximately 45%.

5. A shirt according to claim 4, wherein:

said first yarn has a Denier of between 75 D and 100 D and said second yarn has a Denier of between 30 D and 40 D.

6. A shirt according to claim 3, wherein:

said first and second yarns are knitted together with between twenty-four and thirty-two stitches per inch.

7. A shirt according to claim 3, wherein:

said fabric weight is between 160 g/m$^2$ and 200 g/m$^2$.

8. A shirt according to claim 2, wherein:

said first and second yarns are twisted at least one half twist per stitch.

9. A shirt according to claim 2, wherein:

said first and second yarns are twisted at least one twist per stitch.

10. A shirt formed from a resilient fabric comprised of a first yarn formed from first fibers of a first material and a second yarn formed from a second material, said first yarn and second yarn twisted and knitted together, said first yarn having surfaces adapted to channel liquid from wet areas to dry areas and said first yarn having pores adapted to permit evaporation of liquid vapor therethrough, said second yarn being resilient and capable of being stretched at least 300% without deforming, said first yarn constituting between 85% and 95% of the weight of the fabric, said resilient fabric being capable of being resiliently stretched at least 40% in each of two perpendicular directions without tearing and returning immediately to its at-rest position.

11. A shirt according to claim 10, wherein:

said second yarn is stretched between 200% and 500% of its at-rest length when knitted together with said first yarn.

12. A shirt according to claim 11, wherein:

said first yarn has a porosity of between approximately 20% and approximately 45%.

13. A shirt according to claim 11, wherein:

said first and second yarns are knitted together with between twenty-four and thirty-two stitches per inch, and said fabric weight is between 160 g/m$^2$ and 200 g/m$^2$.

14. A shirt according to claim 11, wherein:

said first and second yarns are twisted at least one half twist per stitch.

15. A shirt according to claim 11, wherein:

said first fibers are hydrophilic polyester fibers, and said second material is spandex.

16. A method of making a shirt, comprising:

twisting first and second yarns together and knitting the twisted yarns into a fabric while said second fibers are stretched at least 200% of their at-rest length, said first yarn formed from polyester fibers with surfaces adapted to channel liquid from wet areas to dry areas, said first yarn having pores adapted to permit evaporation of liquid vapor therethrough and constituting between 85% and 95% of the weight of the fabric, and said second yarn being a highly elastic polyurethane-polyurea copolymer constituting the remainder of the fabric by weight;

cutting the fabric to form at least first and second panels formed from said fabric; and sewing said first and second panels into a shirt defining a neck opening.

17. A method according to claim 16, wherein:

said shirt is capable of being resiliently stretched at least 40% in each of two perpendicular directions without tearing and returning immediately to its at-rest position.

18. A method according to claim 16, wherein:

said first yarn has a porosity of between approximately 20% and approximately 45%.

19. A method according to claim 17, wherein:

said first and second yarns are knitted together with between twenty-four and thirty-two stitches per inch, and said fabric weight is between 160 g/m$^2$ and 200 g/m$^2$.

20. A method according to claim 17, wherein:

said knitting comprises generating multiple stitches per inch, and said twisting comprises twisting so that said yarns are twisted at least one half twist per stitch.

* * * * *